United States Patent [19]

Fischer

[11] Patent Number: 4,815,380

[45] Date of Patent: Mar. 28, 1989

[54] PRINTING MACHINE CYLINDER WITH ADJUSTABLE GROOVE COVER ELEMENT

[75] Inventor: Hermann Fischer, Augsburg, Fed. Rep. of Germany

[73] Assignee: M.A.N. Roland Druckmaschinen AG, Offenbach am Main, Fed. Rep. of Germany

[21] Appl. No.: 154,955

[22] Filed: Feb. 10, 1988

[30] Foreign Application Priority Data

Feb. 21, 1987 [DE] Fed. Rep. of Germany ..... 3705593
Feb. 21, 1987 [DE] Fed. Rep. of Germany ..... 3705594

[51] Int. Cl.[4] ..... B41F 7/20; B41F 13/08

[52] U.S. Cl. ..... 101/375; 101/415.1; 101/426

[58] Field of Search ..... 101/415.1, 378, 375, 101/426

[56] References Cited

U.S. PATENT DOCUMENTS

| | | | |
|---|---|---|---|
| 1,900,664 | 3/1933 | Pritchard | 101/415.1 |
| 4,217,824 | 8/1980 | Rebel et al. | 101/375 |
| 4,510,869 | 4/1985 | Fischer | 101/415.1 |
| 4,742,769 | 5/1988 | Zeller | 101/216 |

FOREIGN PATENT DOCUMENTS

| | | | |
|---|---|---|---|
| 640262 | 12/1936 | Fed. Rep. of Germany | 101/415.1 |
| 701996 | 1/1941 | Fed. Rep. of Germany . | |
| 2092069 | 8/1982 | United Kingdom | 101/415.1 |

*Primary Examiner*—Clifford D. Crowder
*Attorney, Agent, or Firm*—Frishauf, Holtz, Goodman & Woodward

[57] ABSTRACT

To permit continuous adjustment of a groove cover element (15), the groove cover element is extended in the groove, formed with a through-bore (14) in which an eccentric cam (7) is located, which can be rotated by a spindle. By rotating the spindle, the cover element is raised from the groove, or lowered against a rubber blanket, printing plate or the like thereon. The spindle can be locked in rotated position by a counter nut (FIG. 1) or can be free to rock continuously during rotation of the cylinder by linking the spindle to an arm which rides on a fixed cam. The cam can be adjusted so that the position of the spindle, and hence of the groove cover element, will be flush with the cylinder just at the time when the cylinder rolls off against an adjacent cylinder (100). Adjustment of the cam can be manual, for example via a worm gear drive, or electrically, for example by a stepping motor, so that automatic speed-dependent positional adjustment of the cam is possible.

18 Claims, 6 Drawing Sheets

PRINTING MACHINE CYLINDER WITH ADJUSTABLE GROOVE COVER ELEMENT

The present invention relates to printing machinery and more particularly to rotary printing machine which utilize cylinders formed with a cylinder groove, in which covers, such as rubber blankets, printing plates and the like can be attached, and especially to an arrangement to prevent shocks and vibrations upon rolling-off of cylinder grooves against each other.

BACKGROUND

It has previously been proposed to provide insert elements which cover grooves and adjust the inserts radially—see, for example, German Pat. No. 640,262. The insert elements are used to clamp flexible printing plates. Adjustment screws for the insert elements are operated by angle gear drives and an adjustment spindle. It is difficult to precisely adjust the insert element radially. Precise adjustment is hardly possible since the insert element must be moved over a distance sufficient to cause the printing plate to be pressed against the edge of the cylinder groove. Shocks and vibrations which occur in operation can be accepted only by engagement of the insert with the edge of the cylinder groove. The adjustment is possible only when the cylinder is stationary.

German Pat. No. 236,935 describes an arrangement which permits adjustment of the height position of an insert element. To adjust the insert element radially with respect to the cylinder with which it is used, in other words the height position of the cylinder, two adjustment screws are provided which engage with one end in the groove of the cylinder, the other end being screwed into the insert element. The adjustment of these screws can be effected only when the insert piece is taken out of the cylinder groove. Thus, only successive trial-and-error placements of the insert element can result in reasonably well adjusted alignment of the insert element, which is extremely timeconsuming. Of course, the adjustment screws can be operated only when the cylinder is stationary.

THE INVENTION

It is an object to provide an arrangement in which the radial adjustment of an insert element can be carried out simply and without play to obtain a precise positioning, in radial direction, of the insert element; and, additionally, to permit such precise positioning or re-positioning even during operation of the cylinder, that is, while it is rotating in the printing machine.

Briefly, a rotatable spindle is introduced into the groove of the cylinder to which a cam element is secured, to rotate with rotation of the spindle. The cam element is interposed between the spindle and the cover element. Preferably, the cam element and the cover element form an axially and radially interengaging fit, so that good coupling between the cam and the insert element is provided. Radial adjustment of the insert element then is simple, merely by rotation of the spindle. This rotation of the spindle can be done by an externally accessible stub, with a square or hexagonal end; in accordance with a feature of the invention, the spindle can be rotated over limited angular distances also while the cylinder is rotating. To permit adjustment in radial direction during rotation of the cylinder, a cam follower is secured to the spindle, located adjacent an end side wall of the cylinder. A control cam is movably positioned on the side wall of the machine in engagement with the cam follower, the control cam defining a control curve. The position of the control curve can be adjusted.

In accordance with a particularly suitable arrangement, the cam follower is a roller rotatable with the cylinder and coupled to the spindle via a roller arm, to rock the spindle about its axis and, thereby, adjust the inner cam and the radial position of the cover element. The control cam curve is secured to the frame of the machine, in position for engagement by the roller. The relative position of the control cam curve element is adjustable, so that the angular position determines the angular position of the cylinder at which selected radial positions of the groove cover element occur. Thus, the radial position of the groove cover element, at the instant that it rolls off against an associated cylinder, can be precisely determined. When the groove cover element does not roll off against another cylinder, its radial position and precise support by the inner cam is not critical.

The invention is suitable for various types of printing machines, for example for rotary intaglio printing machines, to ensure proper operation of a doctor blade. It is equally applicable to other rotary printing machines, particularly for offset printing, Di-Litho printing, and the like, in order to prevent shocks which occur as two cylinders, each having a groove, run off against each other, and especially to prevent the sudden and abrupt changes in engagement pressure between such cylinders. Such abrupt changes in pressure lead to striping of a printing substrate, by causing stripes of different inking intensity.

The present invention is equally suitable in raised letter printing machines and, if so used, the specific advantage obtains that the height position of the insert element can be changed during operation until the printing becomes even and any striping which might have occurred is avoided by eliminating shocks which occur when the cylinder groove of an associated cylinder runs off the cylinder equipped with the insert element. This, then, additionally permits adjustment of the height or radial position of the insert element in accordance with the rotary speed of the respective cylinder. Thus, the radial position of the insert element can be immediately adjusted to match any changed speed, if required.

DRAWING

DETAILED DESCRIPTION

Figure 1:
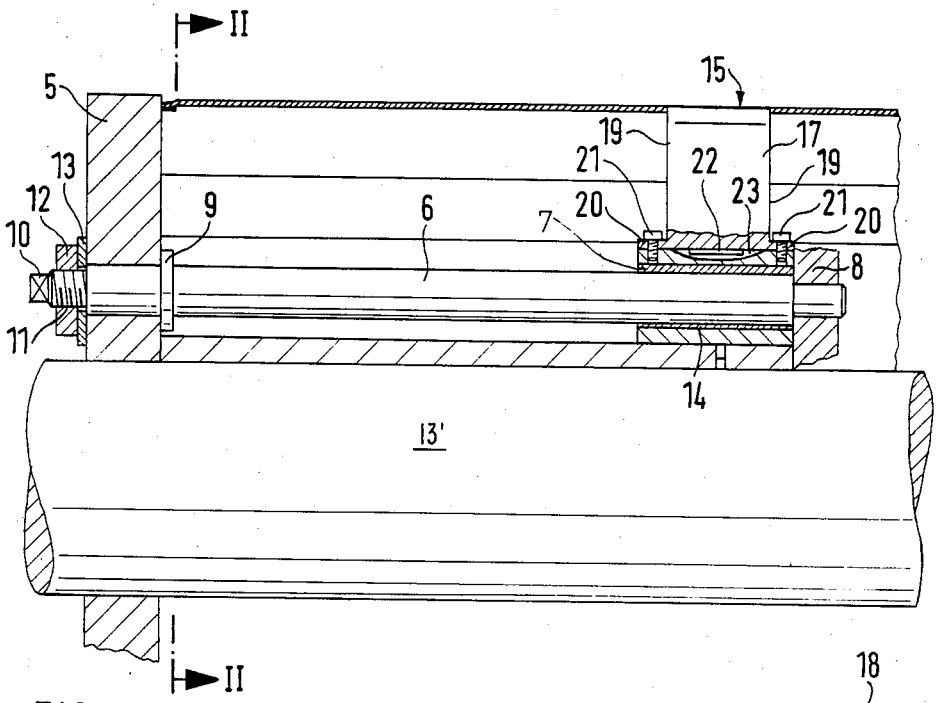
FIG. 1 is a fragmentary part-sectional elevational view through a printing cylinder, with an insert element and a fixed adjustment arrangement therefor.

The invention will be described in connection with a blanket cylinder of a rotary offset printing machine. Of course, it is applicable to different cylinders of such a machine as well as to other cylinders of other types of rotary printing machines.

A cylinder 1 (FIGS. 1–3) has a groove 2 in which two spindles 3 are located to secure and stretch the two ends of a rubber blanket 4. The groove 2 is closed off at the two facing ends of the cylinder 1 by an end wall 5 (FIG. 1), of which only one is shown. The cylinder groove 2 retains a positioning spindle 6, extending parallel to the shaft 13' (FIG. 4) of the cylinder. An insert element 15 is located in the groove. The spindle 6 carries a cam element 7 (FIG. 1), positioned at least approximately in the center of the cylinder. U.S. patent application Ser. No. 06/927,734, filed Nov. 5, 1986, Zeller, now U.S. Pat. No. 4,742,769, the disclosure of which is hereby incorporated by reference, and assigned to the assignee of the present application, describes an insert element 15, the operation, and the position thereof, in detail.

The spindle 6 is retained in a bearing 8 which is securely retained within the cylinder. It may, for example, be supported on an inner cylinder element which is, in turn, supported on the shaft 13'. The other end of the spindle is supported on the end facing wall 5 of the cylinder 1. The spindle 6 is formed with a flange 9, engaging the inside of the facing wall 5. The end of the spindle 6 which extends through the wall 5 is formed with a polygonal wrench engagement projection 10, for example of hexagonal or square cross section. Additionally, the projecting end is threaded, as seen at 11, on which a clamping nut 12 is screwed. A washer 13, for example a lock washer, is placed between the nut 12 and the end face wall 5.

An insert element 15 is located in the center of the cylinder. A positioning or adjustment cam 7 is secured to the spindle 6, to rotate with the spindle. The cam 7 has a close but movable fit within a recess 14 of the insert 15, the fit being so arranged that the cam 7 can rotate in the recess 14 without play. The outer surface of the cam 7 is circular. It is secured on the spindle eccentrically with respect to the outer surface. Upon proper placement on the spindle 6, the construction has the advantage that a given angle of rotation of the adjustment cam 7, and hence of the spindle 6, results in approximately uniformly changing radial positioning paths or distances of the insert element 15.

The insert element 15 has an inner part 16, formed with a recess, in the embodiment shown the throughbore 14, and an outer part 17. The outer part 17 has an end surface 18 which is formed as a portion of the outer surface of the cylinder 1. The outer portion 17 has flanges 20, extending from the end faces 19 of the insert 15. A screw 21 is engaged through the respective flanges, which can be coupled with a threaded bore in the inner part 16, so that, after loosening of the screws 20, the outer part 17 can be lifted outwardly through the cylinder groove, for removal. This arrangement easily permits removal of the rubber blanket 4, and exchange thereof.

The axial and radial position of the outer part 17 is accurately defined with respect to the inner part 16 by a projection 22 which projects from the outer part 17 into a matching groove 23 in the upper side of the inner part 16. To prevent undesired relative rotation of the inner part 16 with respect to the cylinder 1, the inner part 16 is formed with a projecting tip 24 which engages in a groove 25 of the cylinder 1.

The insert element 15 extends only over a short portion or section of the length of the cylinder 2; as described in the referenced application, now U.S. Pat. No. 4,742,769, the insert element 15 may have an axial length of, for example, between about 5–10 cm, preferably about 5 cm. Rather than using a single insert element, two or more such insert elements may be provided. Preferably, a bearing similar to bearing 8 is then located immediately adjacent each one of the adjustment cams 7 in order to prevent bending of the spindle 6 under forces acting on the respective insert elements, and thus prevent change in position of the outer part of the insert element 15.

The axial, or height position of the outer surface 18 of the insert element 15 is readily adjusted by loosening the lock nut 12, and rotating the spindle 6 by a socket wrench or the like, engaging over the polygonal end 10. This rotates the cam 7 which shifts the insert element 15 in radial direction. When the outer surface 18 of the insert element 15 has reached the appropriate position, the nut 12 is tightened and thus the spindle 6 and hence the insert element 15 is secured in fixed position on the cylinder.

In accordance with a feature of the invention, adjustment of the position of the insert element can be carried out not only when the cylinder is stationary but also when the cylinder is rotating. Referring now to FIGS. 4 through 9, in which similar elements have been given similar reference numerals;

The spindle 6' is extended outwardly of the facing wall 5' and retains a control lever 9', which carries a cam follower roller 10'. The cam follower roller 10' is retained by a spring 11 in engagement with a control curve cam 12'. The control curve cam 12' is freely rotatable on the shaft 13' of the cylinder 1. The control cam 12' is securely attached to a worm wheel 14' which is engaged by a worm 15', secured on the shaft 16'. Shaft 16' is retained in any suitable manner—not shown—on a side wall 17' of the printing machine. A hand wheel or other suitable engagement element, likewise not shown, is provided to rotate the shaft 16'. The cylinder 1 is driven by a gear 18', secured to the shaft 13' of the cylinder 1, and in engagement with the drive mechanism of the printing machine.

Figure 2:
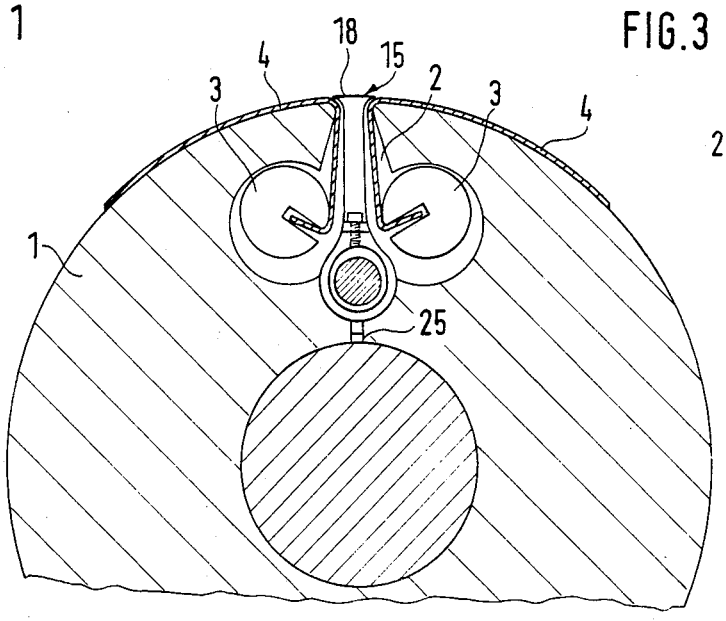
FIG. 2 is a fragmentary schematic sectional view through the cylinder of FIG. 1.
Figure 3:
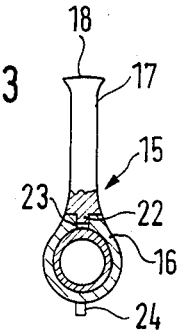
FIG. 3 is a fragmentary part-sectional view through an insert element.
Figure 4:
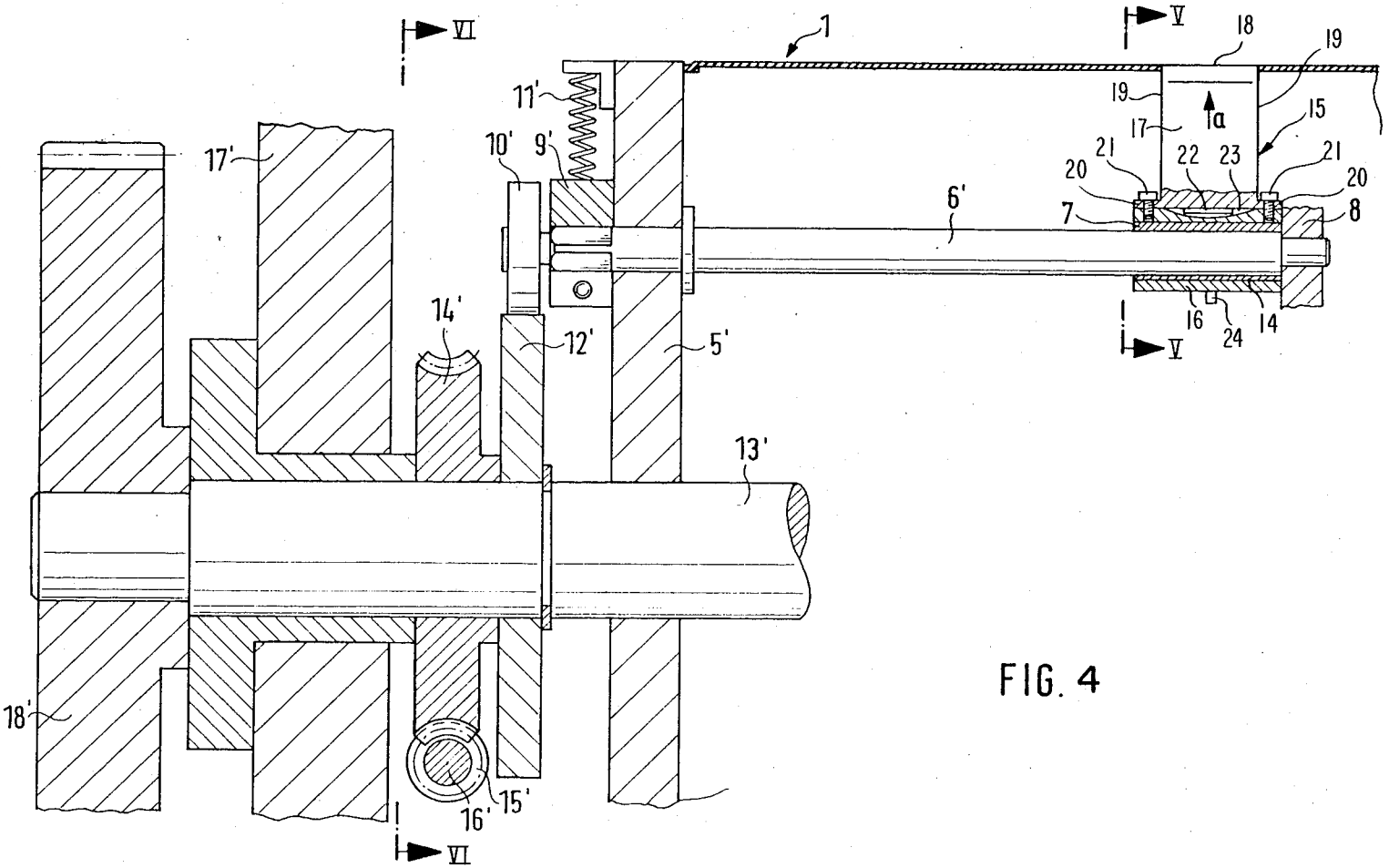
FIG. 4 is a fragmentary sectional view similar to FIG. 1, and illustrating an external adjustment, permitting adjustment of the radial position of an insert in operation of the machine.
Figure 5:
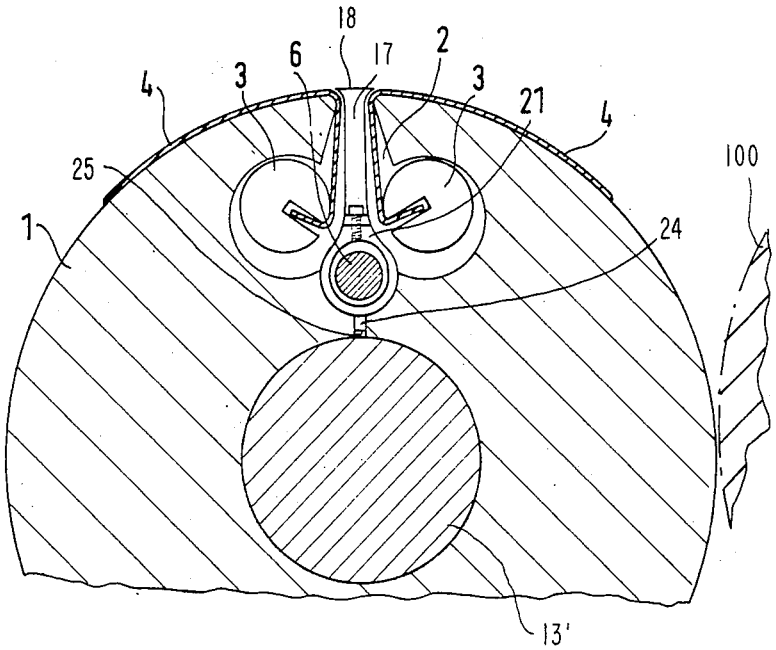
FIG. 5 is a cross-sectional view along line V—V of FIG. 4.
Figure 6:
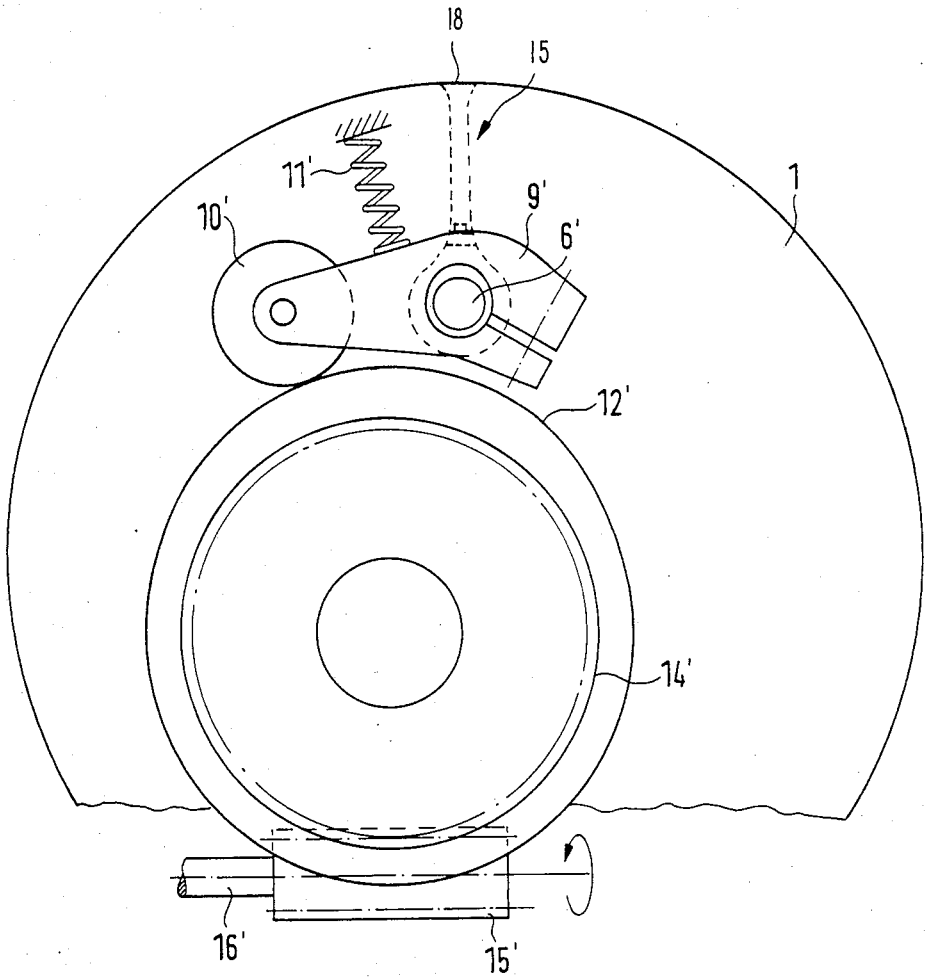
FIG. 6 is a cross-sectional view along line VI—VI of FIG. 4.

The spindle 6' carries the eccentric or cam 7; the construction and arrangement of the insert element 15 on the eccentric is identical to that described in connection with FIGS. 1–3. FIG. 4 also identifies the bore hole 14 formed in the lower part 16 of the insert element 15, and in which the eccentric cam element 7 engages, permitting rotation, but without play. The outer surface of the eccentric cam 7, again, is circular, and eccentrically positioned with respect to the spindle 6'. Preferably, the width of the insert element 15 corresponds at least approximately to the width of the eccentric cam 7.

OPERATION

When gear 18' drives the cylinder 1, the cam follower roller 10' runs off the control cam surface of cam 12'. Upon each rotation, the lever 9' will rock or oscillate back and forth by a small rocking distance. Since the lever 9' is secured to the spindle 6', the spindle 6' will likewise pivot or rotate about a small angle. This movement is transmitted to the inner cam 7 and, consequently, the insert 15, upon each rotation of the cylinder 1, moves in the direction of the arrow a (FIG. 4) and then counter the direction of the arrow a.

The cam 12' is so adjusted that the outer surface 18 forms a complete circular circumference with the cylinder 1 just at the time when the insert element 15, and hence the groove 2 of the cylinder 1, runs off against an adjacent cylinder 100, so that the insert element 15 closes the outer circumference of the cylinder, as defined by the rubber blanket, to a complete circle, when looked at in cross section.

In operation, and particularly if the machine speed should change, stripes of different inking intensity may occur on the printed substrate. Adjustment of the cam curve can be easily obtained by rotating the cam 12' through the worm gear 14', 15', 16' until the striping on the printed substrates disappears. By rotating the cam 12', the height or radial position of the outer surface 18 of the insert element 15 is changed at the instant of time when the cylinder groove 2 and hence the insert element 15 run off against the circumference, or, for example, another similar insert element of an engaged cylinder 100.

Figure 7:
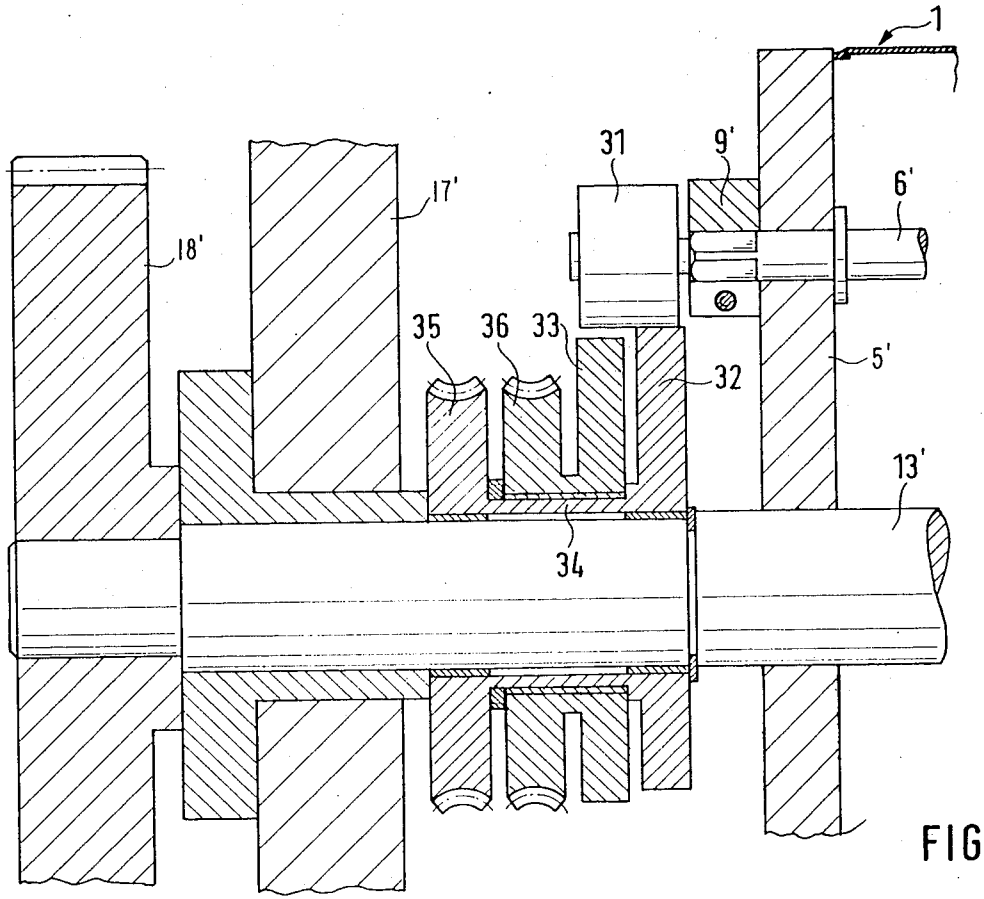
FIG. 7 illustrates a modification, and is a view, otherwise, essentially similar to that of FIG. 4.

Embodiment of FIG. 7: The control lever 9', secured to the spindle 6' carries a cam follower 31 of increased width. The cam follower roller 31 can be selectively engaged with a first control cam 32 or a second control cam 33. Control cam 32 is rotatably positioned on the shaft 13' of the cylinder 1 and coupled via a sleeve-like extension 34 with a first worm wheel 35. A second control cam 33 is located freely rotatable on the sleeve 34 which, in turn, is secured to a second worm wheel 36.

Each of the two first and second worm wheels engage, as in the embodiment of FIG. 4, with a respective worm—not shown—which in turn is coupled to a manually adjustable positioning shaft.

The dual-control cam arrangement has the advantage that during any one revolution of the cylinder 1, the insert element 15 can be brought twice in the appropriate radial or height position which it should have when it runs off an associated cylinder. Thus, the respective cylinder 1 can be engaged with more than one cylinder, each one carrying a groove. Such an arrangement is particularly suitable for recto-and-verso offset printing, in which a substrate is printed by being passed between two rubber blanket cylinders, each one of which also has an associated plate cylinder.

Figure 8:
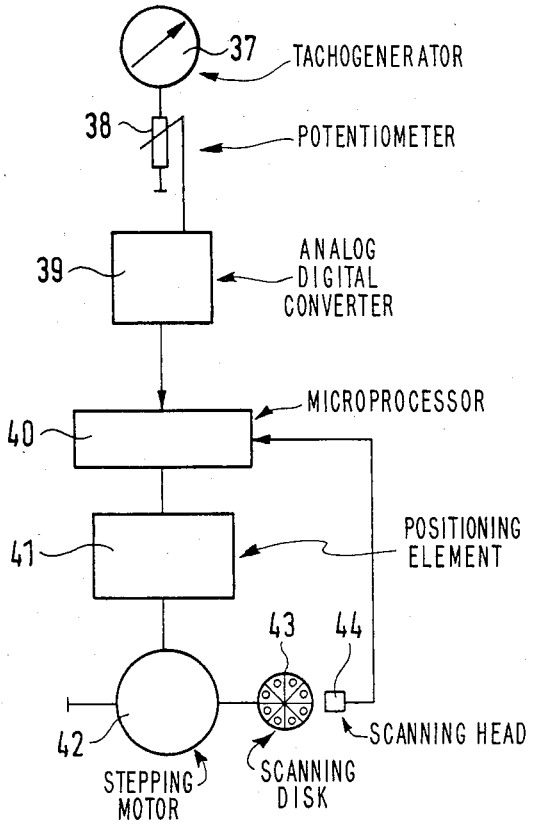
FIG. 8 is a schematic circuit and operating diagram of an adjustment arrangement.
Figure 9:
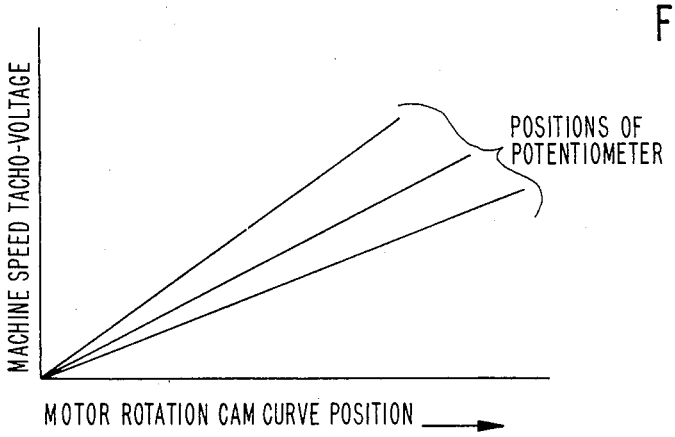
FIG. 9 is a diagram illustrating different operating and adjustment parameters.

In accordance with another embodiment of the invention, the desired radial position of the insert element can be obtained by an electrical adjustment arrangement. Referring to FIG. 8: A tacho generator 37 is coupled to the shaft 13' of the cylinder 1, for example by being secured thereto. The tacho generator 37 provides an output voltage which is coupled via a calibration potentiometer 38 to an analog/digital (A/D) converter 39. The digitized output is then applied to a microprocessor 40 where the digital signals can be processed. The microprocessor 40 has a program in which the number of pulses, that is, the speed signal from the tacho generator is determined and the respective number of pulses, per unit time, then control a positioning element 41 which, in turn, provides output signals of appropriate power level to step a stepping motor 42. The stepping motor 42 can rotate the cam curve or curves 12' or 32, 33 directly, or via a gear or worm drive. To provide feedback, the rotating steps of the stepping motor are counted or scanned by a scanning disk 43 which is coupled to a contactless scanning head 44, which counts the number of steps of angular displacements of the stepping motor per unit time, the count being fed back to the microprocessor 40. When that count number has been reached which corresponds to the appropriate position of the respective cam 12', 32, 33 at the then existing speed of the motor, the stepping motor 42 is stopped. Thus, the tachometer generator voltage is easily transformed into a predetermined stepping number for the stepping motor 42. High output voltage of the tacho generator 37 corresponds to a large number of steps; a lower voltage corresponds to a lesser number of steps. The potentiometer 39. which can be termed the calibration potentiometer, can change the voltage applied from the tacho generator 37 to the A/D converter 39. It is thus easily possible to associate a specific speed of the machine with a specific number of steps of the stepping motors and to obtain different characteristics, to thereby readily accomodate variations which can compensate for different hardness characteristics of the cover on the cylinder, that is, whether the cover is a hard plate, a rubber blanket, or of other material.

The microprocessor itself can be of any suitable and standard construction and need merely compare the input signal derived from the A/D converter with the derived signals from the scanning head 44 and provide an output signal to the positioning element only if there is a discrepancy—in other words, functioning merely as a digital servo adjustment or controller element, well known in the industry. The positioning element 41 merely receives the electrical output from the microprocessor and converts into form suitable for control of the stepping motor. Such positioning elements are commercial articles.

Various changes and modifications may be made, and features described in connection with any one of the embodiments may be used with any of the others, within the scope of the inventive concept.

I claim:

1. A rotary printing machine having a cylinder (1) formed with an axial groove (2) to receive a cover (4) thereon, comprising a groove cover element (15) located in the groove and having an outer portion (17) defining an outer surface (18) covering the groove and an inner portion (16) located within the groove, said inner portion (16) of the cover element (15) being formed with a bore extending axially with respect to the cylinder;

an adjustable spindle (6) extending axially into the cylinder and passing through said bore in the cover element, and a cam element (7) located in the bore of the cover element and interposed between the spindle (6) and the cover element (15), said cam element being secured to the spindle to be rotatable therewith, said cam element and cover element being in engagement with each other, and controlling the radial position of said cover element with respect to the axis of rotation of the cylinder.

2. The printing machine of claim 1, wherein the cam element has, in cross section, circular shape and is secured eccentrically on the spindle (6).

3. The printing machine of claim 1, wherein said bore in the inner portion (16) of the groove cover element

(15) is an a through-bore (14), said cam element extending within the through-bore;

wherein the outer portion (17) comprises an outer part formed with flanges (20) extending axially from the outer part;

and releasable connection means (21) releasably coupling the inner portion and the outer part together, while permitting removal of the outer part.

4. The printing machine of claim 3, further including interengagement means (24, 25) coupled to the inner portion and to the cylinder, respectively, and shaped to retain the inner portion in position and restrained against relative rotation with respect to the cylinder.

5. The printing machine of claim 1, wherein the cylinder (1) has an end wall (5, 5');

the spindle (6) is formed with a flange (9) engaging against the inner wall of the end wall of the cylinder, the spindle extending through the end wall of the cylinder and being formed with means (10) for rotating the spindle;

and clamping means (11, 12, 13) engageable with a portion of the spindle extending at the outside of the end wall to clamp the spindle in adjusted rotated position against the end wall of the cylinder.

6. The printing machine of claim 1, further including a bearing (8) rotatably locating the spindle and supporting the spindle at the position close to the engagement of the cam element (7) with the cover element.

7. The printing machine of claim 1, further including a cam follower (9', 10') located adjacent an end wall (5) of the cylinder, and secured to a portion of the spindle (6') extending through the end wall;

a control curve means (12', 32, 33) movably positioned on a side wall (17) of the machine and located for engagement by said cam follower; and means (14', 15', 16'; 35, 36; 37–44) coupled to the control curve means for adjusting the position of the control curve means.

8. The printing machine of claim 7, wherein the means for adjusting the control curve means comprises a worm drive (14', 15; 35, 36) having a worm wheel (14'; 35, 36) coupled for rotation with the control curve means (12', 32, 33).

9. The printing machine of claim 8, wherein the worm drive includes a worm wheel (14) rotatable on a shaft (13') of the cylinder.

10. The printing machine of claim 8, wherein the worm drive is manually operable to provide for manual adjustment of the position of the control cam curve means (12, 32, 33).

11. The printing machine of claim 7, including an electric servo motor means (37–42) coupled to the means for adjusting the control curve means to determine the position of the control curve means.

12. The printing machine of claim 11, wherein the servo motor means includes speed sensing means (37) coupled to the printing machine and providing a speed signal representative of the rotary speed of the cylinder;

and circuit means (38–41; 43, 44) controlling the speed of a positioning motor (42) to control rotation of the positioning motor as a function of speed of the printing machine, and hence position the control curve means based on printing machine speed.

13. The printing machine of claim 12, wherein the means to provide the speed signal comprises a tacho generator (37) coupled to and rotating with the cylinder (1);

feedback means (43, 44) coupled to the motor and providing a motor operation feedback signal;

and comparator means (40) comparing an output signal derived from the tacho generator with the feedback signal derived from the feedback means to control the motor (42) in the closed servo loop.

14. The printing machine of claim 13, further including a calibration means (38) modifying the signal derived from the tacho generator and applied to the comparator to modify the position signal being applied to the comparator and derived from the tacho generator to thereby modify the transfer characteristics of the system including the tacho generator and the motor.

15. The printing machine of claim 7, wherein (FIG. 4) the control curve means comprises two adjacently positioned cam elements (32, 33) and commonly scanned by said cam follower (9', 10') to provide for movement of the spindle in accordance with two control characteristics as determined by the respective cam elements, and thereby permit multiple positioning of the groove cover element (15) during any revolution of the cylinder (1) for engagement of said cylinder with more than one other associated cylinder.

16. The printing machine of claim 7, wherein the cam element has, in cross section, circular shape and is secured eccentrically on the spindle (6).

17. The printing machine of claim 1, further including a rocker arm (9') secured at one end to said spindle and a feeler element (10') secured to said arm at another end, said arm rotating with the cylinder and, upon deflection of said feeler, rocking the spindle about its axis;

outer cam means (12', 32, 33) adjustably secured to a frame element (17') of the machine and in position for engagement by said feeler (10); and adjustment means (14', 15', 16'; 35, 36; 37–44) coupled to said outer cam means (12', 32, 33) for controlling the angular position of said outer cam means to thereby associate the angular position of the cylinder with selected radial positions of the groove cover element and control a predetermined position of the groove cover element with respect to the circumference of the cylinder at a time when the cylinder (1) is rolling off an associated cylinder (100).

18. A method of controlling the position of a cylinder groove cover element (15) covering a portion of a groove (2) in a rotating printing machine cylinder (1), said groove cover element being radially movable by a cam element (7) coupled to a rockable spindle (6'), said method comprising the steps of:

rotating the cylinder;

rocking the spindle by engagement of a rocker arm (9') coupled to the spindle with a stationary cam element (12', 32, 33) which has a cam portion which is non-concentric with respect to the axis of rotation of the cylinder;

and adjusting said cam element to locate the cam portion with respect to the cylinder such that, during the rocking movement of the spindle and hence the radial movement of the groove cover element, the outer surface of the groove cover element will have a predetermined position with respect to the circumference of the cylinder at a predetermined angular position of the cylinder and when the groove (2) of the cylinder is rolling off against an adjacent cylinder (100).

* * * * *